United States Patent [19]

McWilliams

[11] Patent Number: 4,745,645

[45] Date of Patent: May 24, 1988

[54] INFLATABLE INSERT FOR WORN MATTRESSES

[76] Inventor: Douglas J. McWilliams, 1974 34th Ave., Columbus, Nebr. 68601

[21] Appl. No.: 90,208

[22] Filed: Aug. 27, 1987

[51] Int. Cl.[4] ..... A47C 21/00

[52] U.S. Cl. ..... 5/446; 5/455

[58] Field of Search ..... 5/446, 447, 455, 449, 5/441, 508; 297/DIG. 3

[56] References Cited

U.S. PATENT DOCUMENTS

| | | | |
|---|---|---|---|
| 2,543,218 | 2/1951 | Young et al. . | |
| 2,545,310 | 3/1951 | Rosberger . | |
| 2,604,641 | 7/1952 | Reed | 5/455 |
| 2,779,034 | 1/1957 | Arpin . | |
| 3,644,949 | 2/1972 | Diamond | 5/441 |
| 3,644,950 | 2/1972 | Lindsay, Jr. . | |
| 3,751,742 | 8/1973 | Worley . | |
| 4,639,960 | 2/1987 | Quillen et al. | 5/455 |

FOREIGN PATENT DOCUMENTS

| | | | |
|---|---|---|---|
| 2394275 | 2/1979 | France | 5/446 |
| 2105984 | 4/1983 | United Kingdom | 5/455 |
| 572266 | 9/1977 | U.S.S.R. | 5/441. |

*Primary Examiner*—Alexander Grosz

*Attorney, Agent, or Firm*—Zarley, Mckee, Thomte, Voorhees & Sease

[57] ABSTRACT

An insert for worn mattresses comprising lower, intermediate and upper pads with the intermediate pad having a length less than the lower pad and with the upper pad having a length lower than the intermediate pad. Each of the pads are provided with air compartments therein which may be selectively inflated to achieve the desired support. When the insert is inserted between a box spring and a worn mattress, the insert will reduce the sag of the mattress and will provide proper support for the user.

2 Claims, 3 Drawing Sheets

INFLATABLE INSERT FOR WORN MATTRESSES

BACKGROUND OF THE INVENTION

This invention relates to an insert which may be inserted between the spring and mattress of a bed to reduce the sag of the mattress and to provide posture support for the user.

When a mattress becomes worn, it tends to sag in the middle thereby providing very little back support for the user. The only alternative in the past was to replace the worn mattress.

SUMMARY OF THE INVENTION

A mattress insert and/or back support is provided comprising lower, intermediate and upper inflatable pad members. All three of the pad members have identical widths with the intermediate pad member being centrally positioned on the lower pad member and having a length shorter than the lower pad member so that the ends of the lower pad member are exposed. The top pad member is positioned centrally on the intermediate pad member and has a length shorter than the intermediate pad member so that the ends of the intermediate pad member are exposed. Each of the pad members are provided with air compartments therein which are divided into smaller air pockets and have valve members associated therewith to permit the amount of air contained within the pad members to be selectively adjusted.

When the inserted is inserted between a spring and mattress of a bed, the insert will reduce the amount of sag present in the mattress and will provide posture support for the user's back. The insert may also be utilized beneath the cushions of a soda or the like to provide additional back support for a person lying on the sofa.

It is therefore a principal object of the invention to provide an insert for worn mattresses.

A further object of the invention is to provide an inflatable insert which may be positioned between the spring and mattress of a bed to reduce the sag of the mattress.

Yet another object of the invention is to provide an insert for worn mattresses comprising lower, intermediate and upper pad members, each of which are selectively inflatable to provide the desired amount of support.

Still another object of the invention is to provide an inflatable insert which may be used as a back support.

Still another object of the invention is to provide an insert for worn mattresses which is economical of manufacture, durable in use and refined in appearance.

These and other objects will be apparent to those skilled in the art.

DESCRIPTION OF THE PREFERRED EMBODIMENT

Figure 1:
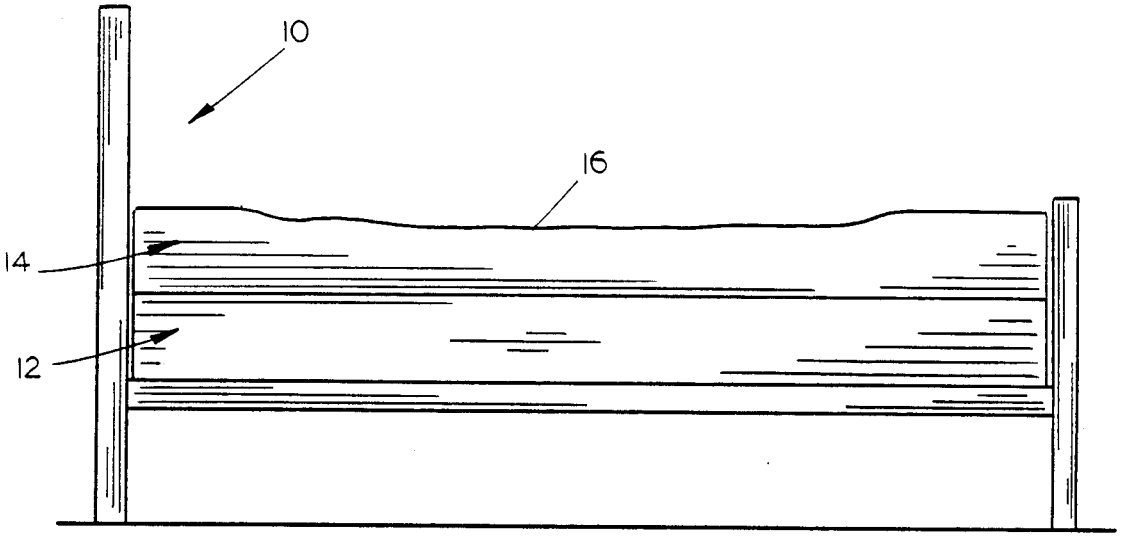
FIG. 1 is a side view of a conventional bed having a box spring and mattress positioned thereon.

The numeral 10 refers to a conventional bed including a box spring 12 and a mattress 14 positioned thereon. As seen in FIG. 1, the upper surface of the mattress sags in the area generally referred to by the reference numeral 16. The insert of this invention is referred to generally by the reference numeral 18 and is comprised of lower, intermediate and upper pad members 20, 22 and 24. Pad members 20, 22 and 24 may be constructed of any suitable material such as rubber, plastic, etc.

For purposes of description, pad 20 will be described as including opposite ends 26 and 28, opposite side edges 30 and 32, top 34 and bottom 36. Pad 20 is provided with a plurality of transversely extending seams 38 provided therein to create a plurality of air pockets 40 which extend transversely across the pad 20 between the top 34 and bottom 36.

Pad 22 includes opposite ends 42 and 44, opposite side edges 46 and 48, top 50 and bottom 52. If desired, bottom 50 of pad 22 may be omitted with the top 34 of pad 20 serving as the bottom of pad 22 providing top 50 is sealed to pad 20 so as to create the desired air compartment therein. In any event, pad 22 defines an air compartment therein which is divided into a plurality of air pockets 54 by the seams 56. As seen in the drawings, pad 22 is centrally positioned on pad 20 so that the ends of pad 20 are exposed.

Pad 24 is centrally positioned on pad 22 so that the ends of pad 22 are exposed as illustrated in the drawings. For purposes of description, pad 24 will be described as comprising opposite ends 58 and 60, opposite side edges 62 and 64, top 66 and bottom 68. Bottom 68 may be omitted providing pad member 24 is sufficiently sealed to pad 22 to create an air compartment therebetween. The air compartment in pad 24 is divided into a plurality of transversely extending air pockets 70 by the seams 72. Valves 74, 76 and 78 are in communication with the air compartments within pads 20, 22 and 24 respectively to permit air to be supplied to the interior of the air compartments or to permit air to be expelled therefrom so that the desired amount of support is provided. It is recommended that the insert 18 have a width of approximately 2 feet with the lengths of the pads 20, 22 and 24 having lengths of 1½ feet, 3½ feet and 5 feet respectively.

The insert would normally be stored in a flat rolled condition without any air being present in the air compartments in the pad 20, 22 and 24. When it is desired to utilize the insert 18, mattress 14 would be lifted from box spring 12 and the insert 18 positioned on the supper surface of the spring 12. If only one side of the mattress is to be effected, the insert 18 would be positioned at one side of the bed. If the entire mattress is to be effected, a pair of the inserts 18 would be positioned in a side-by-side relationship on the spring 12. The mattress 14 is then positioned on the insert 18. An air pump or the like is utilized to supply air to the air compartments of the pads 20, 22 and 24 as desired by providing three separate pads, each of the same may be inflated as desired to achieve the desired support.

Figure 2:
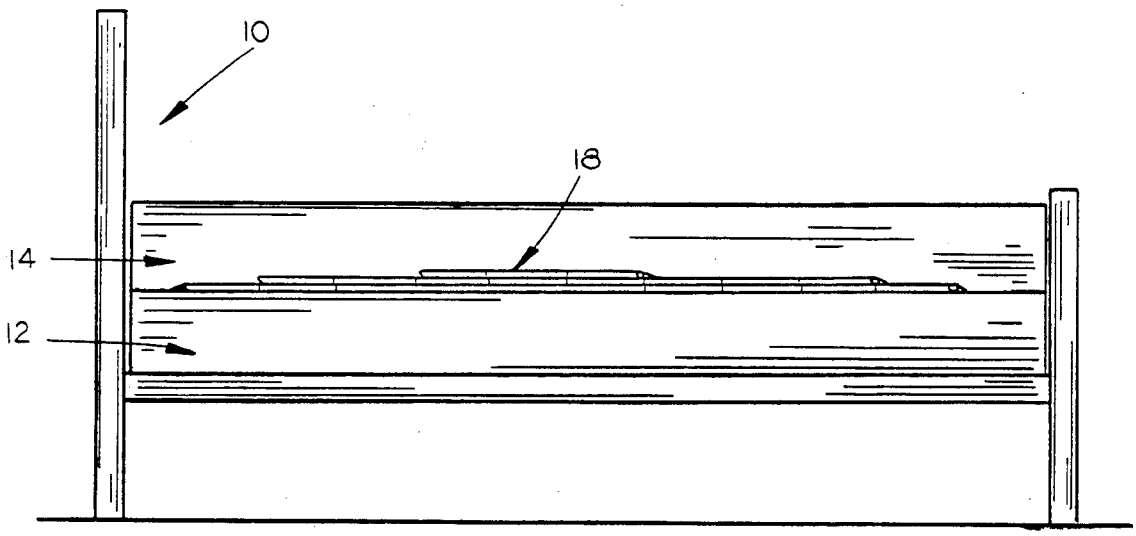
FIG. 2 is a side view of the bed of Figure having the insert of this invention installed therein.
Figure 3:
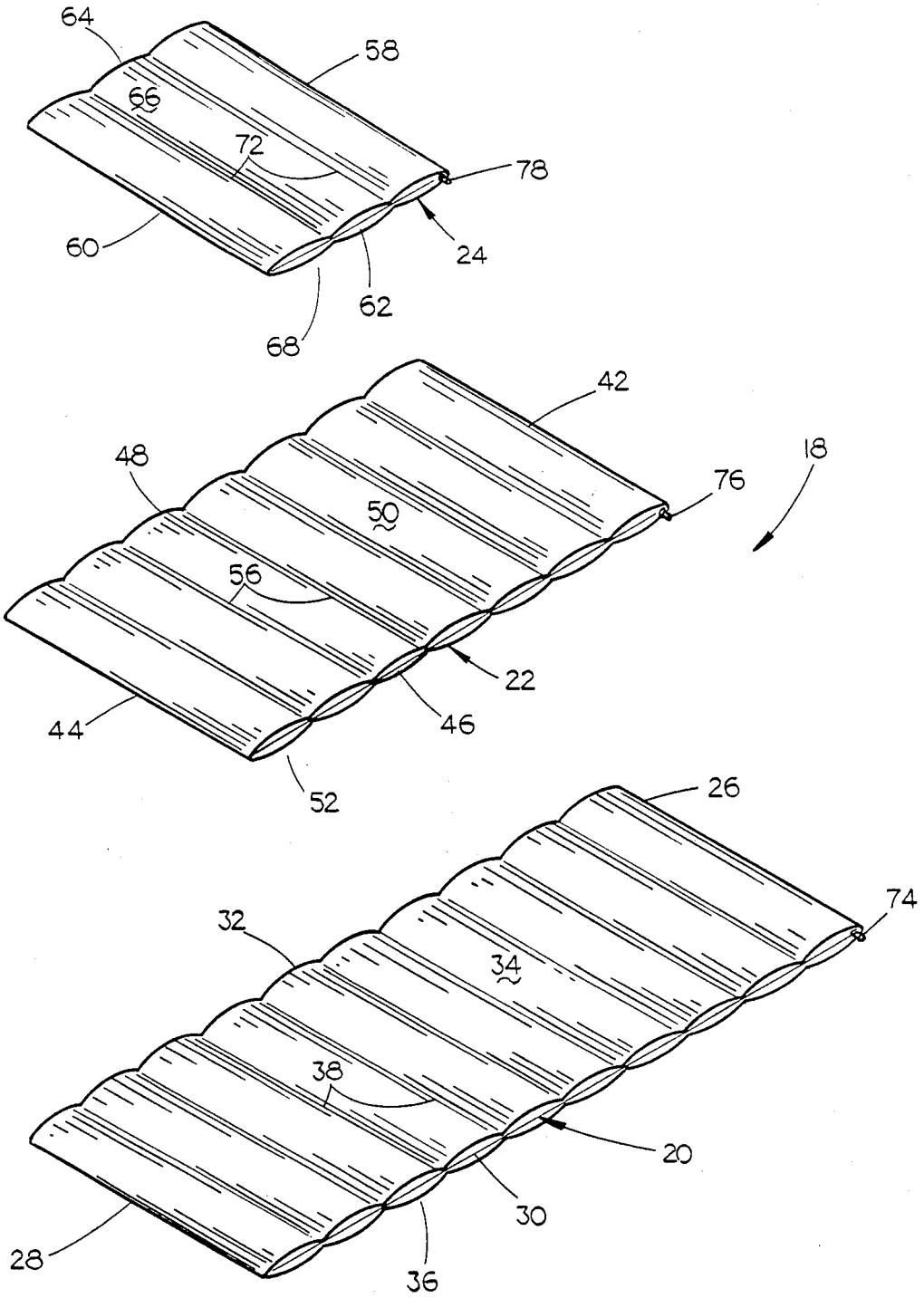
FIG. 3 is an exploded perspective view of the insert of this invention.
Figure 4:
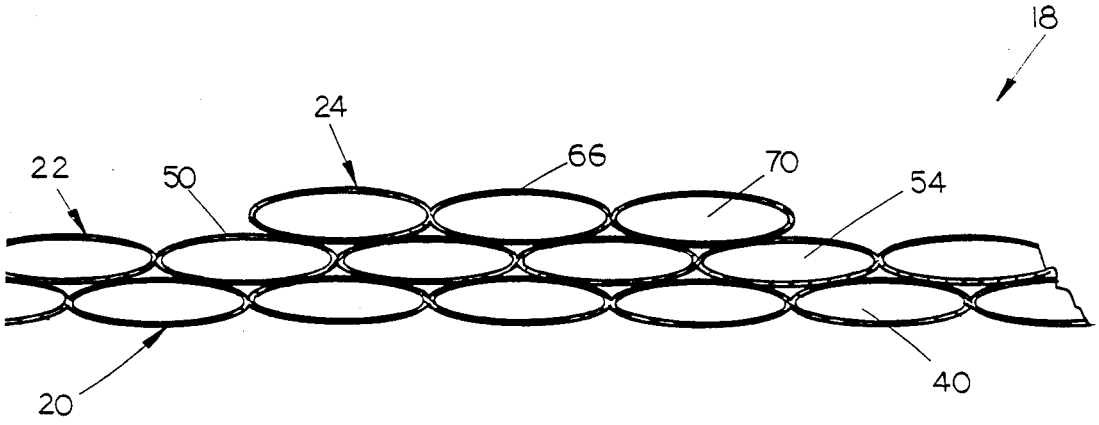
FIG. 4 is a cross sectional view of the insert of this invention.

When the insert 18 has been inflated, the mattress 14 will be raised as illustrated in FIG. 2 thereby eliminating the sag in the worn mattress. By providing the intermediate and top pads in the relationship described, additional support will be provided at the center of the insert which will be positioned so as to provide support for the user's back.

The insert of this invention may also be inserted beneath of the cushions of a soda or the like to provide additional support for a person lying on the sofa. Thus it can be seen that the invention accomplishes at least all of its stated objectives.

I claim:

1. A device for insertion between a box spring and a mattress, comprising, a first generally rectangular pad means including a horizontally disposed bottom pad member, a horizontally disposed top pad member sealed at its periphery to said bottom pad member to define a first air compartment therebetween, said top and bottom pad members having opposite ends and opposite side edges, first valve means for selectively supplying air to said first air compartment, a second pad means generally centrally positioned on top of, and secured to, said top pad member of said first pad means and having a length shorter than said first pad means so that the opposite ends of said first pad means are not covered by said second pad means, said second pad means including a horizontally disposed bottom pad member, a horizontally disposed top pad member sealed at its periphery to said bottom paid member to define a second air compartment therebetween, said top and bottom pad members of said second pad means having opposite ends and opposite side edges, second valve means for selectively supplying air to said second air compartment, said first and second air compartments having a plurality of transversely extending air pockets provided therein, each of said air pockets extending between the opposite edges of said pad members, said mattress insert adapted to be positioned between the box spring and the mattress and at least partially inflated so as to raise a worn portion of the mattress and eliminate sagging.

2. An insert for mattresses, comprising, a first generally rectangular pad means including a disposed top pad member sealed at its periphery to said bottom pad member to define a first air compartment therebetween, said top and bottom pad members having opposite ends and opposite side edges, first valve means for selectively supplying air to said first air compartment, a second pad means generally centrally positioned on top of, said top pad member of said first pad means and having a length shorter than said first pad means so that the opposite ends of said first pad means are not covered by said second pad means, said second pad means including a horizontally disposed bottom pad member, a horizontally disposed top pad member sealed at its periphery to said bottom paid member to define a second air compartment therebetween, said top and bottom pad members of said second pad means having opposite ends and opposite side edges, second valve means for selectively supplying air to said second air compartment, a third pad means generally centrally positioned on top of, said top pad member of said second pad means and having a length shorter than said second pad means so that the opposite ends of said second pad means are not covered by said third pad means, said third pad means including a horizontally disposed bottom pad member, a horizontally disposed top pad member sealed at its periphery to said bottom pad member to define a third air compartment therebetween, said top and bottom pad members of said third pad means having opposite ends and opposite side edges, and third valve means for selectively supplying air to said third air compartment, said first, second and third air compartments having a plurality of transversely extending air pockets provided therein, each of said air pockets extending between the opposite edges of said pad members, said mattress insert adapted to be positioned between the box spring and the mattress and at least partially inflated so as to raise a worn portion of the mattress and eliminate sagging, said third pad means being secured to said second pad means, said second pad means being secured to said first pad means.

* * * * *